United States Patent [19]

Bristow

[11] 4,180,374

[45] Dec. 25, 1979

[54] WELL PUMP PROTECTION SYSTEM

[76] Inventor: Elliott R. Bristow, P.O. Box 292, Grass Valley, Calif. 95945

[21] Appl. No.: 884,244

[22] Filed: Mar. 7, 1978

[51] Int. Cl.[2] ..... F04B 49/02; F04B 49/06

[52] U.S. Cl. ..... 417/12; 417/17; 417/25; 417/26

[58] Field of Search ..... 417/12, 17, 25, 26, 417/38

[56] References Cited

U.S. PATENT DOCUMENTS

| | | | |
|---|---|---|---|
| 2,990,780 | 7/1961 | Kreuter | 417/12 |
| 3,148,622 | 9/1964 | Le Van et al. | 417/12 |
| 3,963,375 | 6/1976 | Curtis | 417/12 |
| 4,124,332 | 11/1978 | Nishijyo | 417/26 |

*Primary Examiner*—William L. Freeh

*Attorney, Agent, or Firm*—Blair, Brown & Kreten

[57] ABSTRACT

Disclosed herein is a protection system for a well pump in which a normal pressure switch is provided in series between this switch and the submerged motor and pump with a low pressure switch which has connected in parallel thereto a timing device which can in turn transmit directions to the pump, motor, control and starter to assure that a pump is not allowed to continue to run when there is no water in the well thereby causing a burnout. Check valves and a bleeder line are carefully positioned in this series to assure that the reading given by the low pressure switch, the normal pressure switch are real readings and that the pump is not inadvertenantly allowed to run due to incorrect signals derived therefrom.

5 Claims, 5 Drawing Figures

WELL PUMP PROTECTION SYSTEM

BRIEF DESCRIPTION OF THE DRAWINGS

It is acknowledged that there are many well pump and motor protective devices now in use. Some of these protective devices incorporate the use of low pressure cut off switch which as it is now marketed is designed to shut down well pump operation electrically whenever the water pressure drops below that of the cut off switches pressure setting. Another words, whenever the well pump runs out of water the pressure in the system drops off and the cut off switch then stops the pump. Theoretically appealing, and admittedly simple, this type of arrangement is not failsafe for it will function only under ideal circumstances. For example, the switch must be installed between the water pressure tank and the check valve and as long as there is pressure in this portion of the system such as when no water is being drawn off, the pressure switch will not function. The pump could have built up pressure to satisfy the switch and then run dry. As long as water is not being drawn out of the system, the pressure will remain and the pump will continue to run in a dry condition.

Additional devices of which applicant is aware include the following references U.S. Pat. Nos. 2,275,066 Otterbourg, 2,933,570 Tutthill, 3,801,889 Quinn, 3,775,025 Maher, Jr., 3,814,543 Gritz, 3,938,910 Douglas, and 3,973,877 Taki. None of these references teach the simple fail safe combination of elements delineated hereinbelow and accordingly the following patent application can be distinguished therefrom by the following summation of advantages.

SUMMARY OF THE INVENTION

Accordingly, the well pump protection device as hereinafter described for submersible pumps and deep well turbines is designed to help prevent the danger of pumps burning out due to insufficient water level within the well itself. The improvements can be summarized as follows:

A low pressure cut off switch is installed in the well plumbing system between the pump check valve and the pressure tank check valve.

A small diameter bleed line is installed in the well plumbing at the same location as the low pressure cut off switch so that the bleed line discharge returns into the well.

And finally a time delayed relay be installed in parallel electric circuit with the low-pressure cut off switch or alternatively a time delay device designed to trigger the low pressure cut off switch to an on or closed circuit for short prescribed intervals. The interval will be the time required to start pumping and establish normal operating pressure in the well system.

By providing these three elements in the configuration delineated hereinafter, submersible pumps and deep well turbines are safe guarded from burning out due to insufficient water level within the well itself.

OBJECT OF THE INVENTION

Accordingly an object of this invention contemplates extending and preserving the life of a submersied well pump or turbine.

Another object contemplates providing a sequencing in the command to a submersied pump or turbine so that the condition of the water level within the pump is known with absolute certainty and the likelihood of a pump burn out due to insufficient water is for all practical purposes eliminated.

Another object contemplates providing an apparatus for performing the above identified objects in which the components are held to a minimum without a loss in the surety that the fail safe operation will be preserved.

These and other objects will be made manifest when considering the following detailed specification and drawings.

BRIEF DESCRIPTION OF THE DRAWINGS

Figure 1:
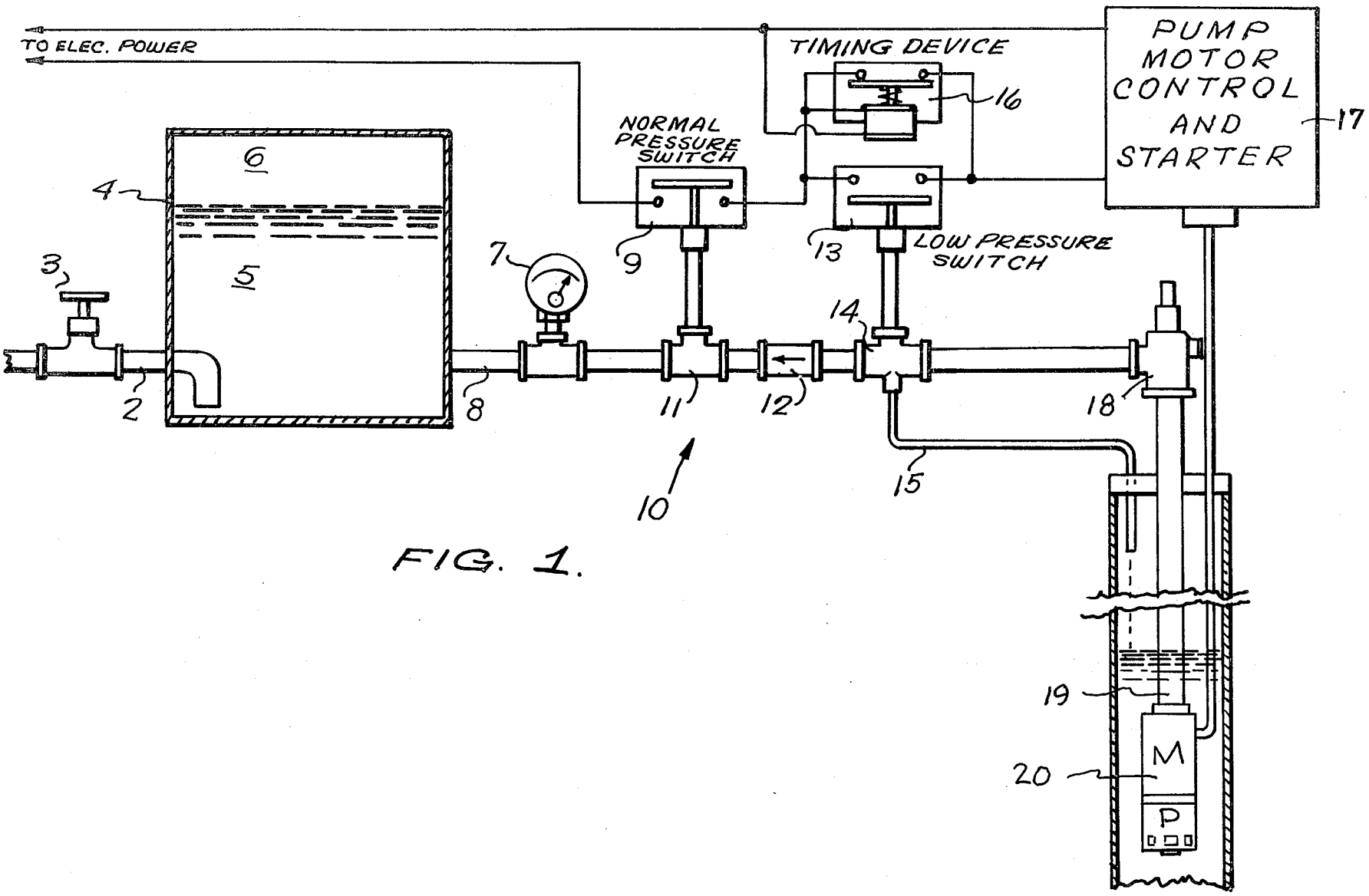
Figure 2:
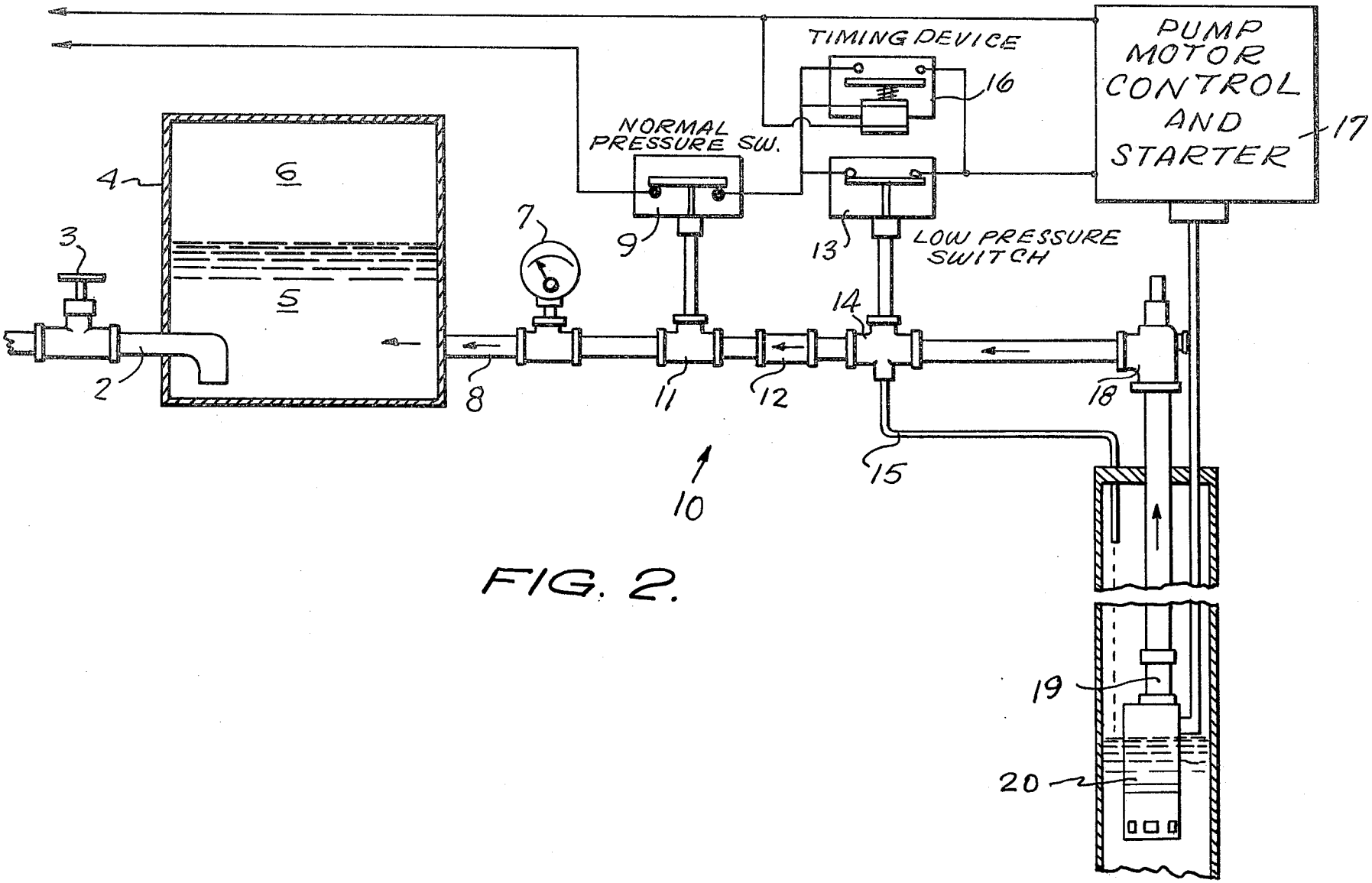
Figure 3:
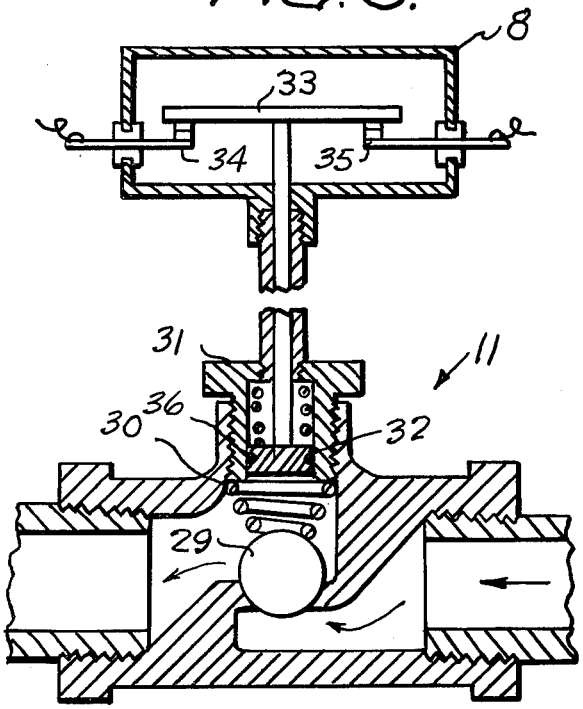
Figure 4:
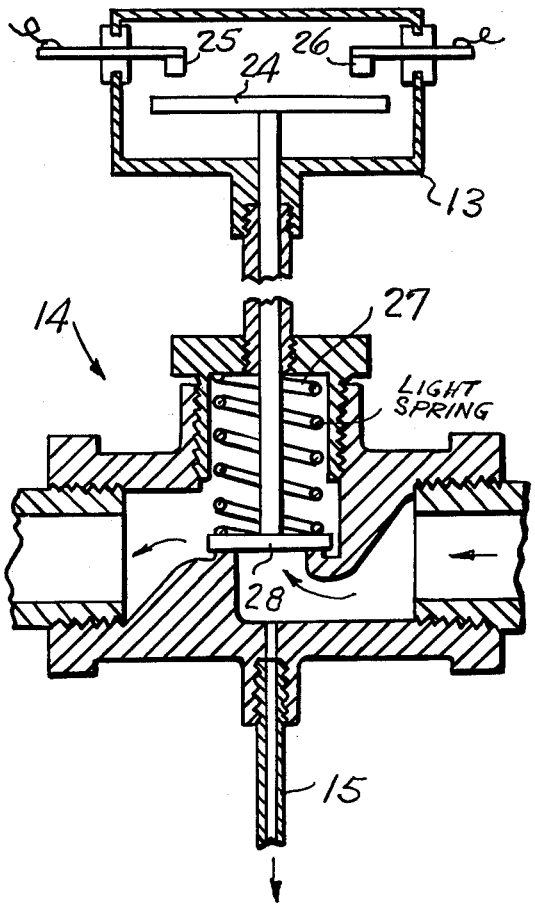
Figure 5:
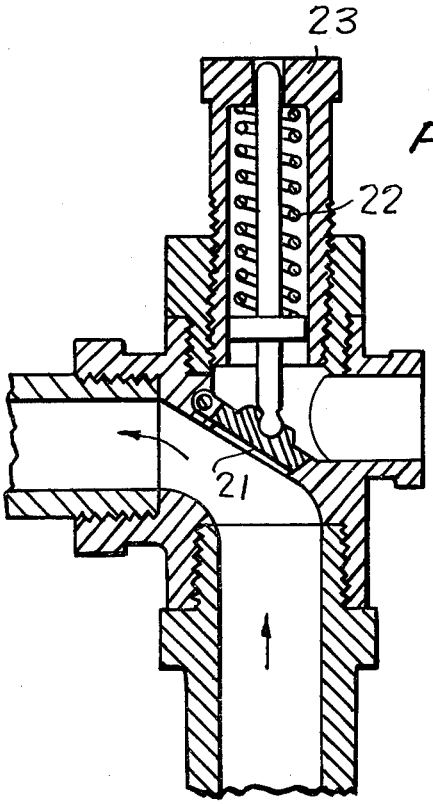

FIG. 1 shows the schematic of a well system in which the pressure in the holding tank is adequate;

FIG. 2 shows a schematic of a well system in which the pressure is inadequate and pumping has begun;

FIG. 3 shows a detailed sectional view of the normal pressure switch shown in FIGS. 1 and 2;

FIG. 4 shows a detailed sectional view of the low pressure switch detailed in FIGS. 1 and 2; and FIG. 5 shows a sectional view of the pressure pop off valve depicted in FIGS. 1 and 2.

DESCRIPTION OF THE PREFERRED EMBODIMENT

Referring to the drawings now wherein like reference numerals refer to like parts throughout the several drawings reference numeral 10 is generally directed to the well pump system.

The system 10 can be defined as follows: a water delivery conduit 2 communicates with the holding tank 4 and is capable of being shut off through valve 3. The water level in holding tank 4 is delineated as reference numerals 5 and 6 in which 5 denotes the water in the tank and 6 denotes the air disposed therein. Connected serially thereto and remote from the water outlet is a pressure gauge 7 communicating with the water tank 4 through conduit 8 and traversing upstream towards the well the following components are to be noted. The normal pressure switch 9 can be regarded as a pair of contacts 34 and 35 separated from each other by contact plate 33 which traverses in a vertical sense and completes the contact thereto. The normal contact switch 9 communicates with a valve assembly 11 and as shown in FIG. 3 is comprised of the following elements. A ball check valve 29 is seated within the flow stream and is biased in a normally closed position via spring 30. The contact plate 33 affects the spring tension of 30 through a piston 32 having an O-ring seal 36 to prevent water seepage vertically upward and is also biased by means of spring 31. Therefore, when the ball is the upper extremity water is allowed to pass therethrough and the ball works against spring 30. Upon demand for water therefore from the pressure tank's switch electric circuit will energize the pump for short period of time. Further upstream and between the normal pressure switch 9 and the low pressure switch 13 there is a check valve 12 which prohibits water from going out of the storage tank 4 back into the well. The low pressure switch comprises a similar type of bridge contact 24 as is the normal pressure switch but is inverted relative thereto and cooperates with contact elements 25 and 26 to complete its circuit. The contact bridge element 24 communicates with the valve 28 located within the conduit of check valve 14 and is also biased by means of spring member 27 and is connected thereto by a rod. Therefore when water is flowing the check valve 28 is upwardly extended and contact is made through the bridge 24 at contacts 25 and 26. Disposed directly below this low pressure switch and valve is a bleed line 15 which returns water back to the well that has been entrained between check valve 12 and the reservoir where the motor and pump is to be described hereinafter. Further upstream there is disposed a pressure pop off valve which can be variable or preset according to the cross sectional configuration in FIG. 5 and is defined as numeral 18. This valve has a gate 21 connected to a rod which is spring biased by means of spring 22 and has an adjustable cap 23 to regulate the tension of the spring 22. In the open condition therefore water will pass thereby. Located further upstream and in proximate relation to the motor and pump assembly 20 is a further check valve 19 which prohibits water from going back in the pump, motor assembly. Pump, motor assembly 20 is energized and given command signals from the pump, motor control and starter 17 which is connected in series to the low pressure switch and the normal pressure switch and the low pressure switch has connected in parallel thereto a timing device 16 comprised of a similar bridge element and contact arrangement as is shown in low pressure switch 13. However this timing device 16 is biased by spring means which is connected to a conventional solenoid type arrangement S.

The sequencing of the operation is therefore as follows upon demand for water from the pressure tank pressure switch, electric current will energize the pump for a short period of time. The time setting is adequate only to pressurize the system and to activate the low pressure cut off switch to an on or flow position. When the water level is adequate this system will operate normally. In the event the water level is inadequate in the well at the initial time of demand, the pump will not build up pressure to satisfy the low pressure cut off switch and the pump will run for only a short period of the time delay setting. In the event the water level becomes inadequate during the pressure tank refill, the bleeder line will relieve the pressure between the two check valves thus activating the low pressure cut off switch to the off position shutting down the pump. To reinstate the pump pressure after such a shut down, the low pressure cut off reset may be activated manually or automatically if so equipped.

Having thus described the invention it will be apparent that the check valve 12 is essential since without it the entire system that is water in storage tank 4 would bleed off.

Having thus described the invention it will be apparent that numerous structural modifications are intended as being a part of this invention as set forth above and as defined in the claims.

What is claimed is:

1. A well pump protection system comprising a water outlet, a valve within said outlet, a storage tank having water and air connecting serially to said outlet, a pressure gauge connected to said pressure tank remote from said water outlet, and serially upstream, a normal pressure switch having means for allowing water to pass downstream, a low pressure switch provided with means to stop water flow downstream, a timing device connected in parallel to said low pressure switch to act as a time lag sequencing device, a bleeder line disposed proximate to said low pressure switch valve connecting said conduit to a well, a check valve disposed between the normal pressure switch and the low pressure switch permitting fluid flow solely in a downstream direction, a pressure pop off valve located upstream from said low pressure switch, a check valve located upstream from said pressure pop off valve allowing water to only flow downstream, and a submersible motor pump disposed in the well, and a pump motor control and starter connected in series to said low pressure switch and said timing device to activate said motor and pump.

2. The device of claim 1 in which said normal pressure switch includes a biased float ball disposed upon a seat, a piston biased against a contact bridge and contact elements at opposed extremities of said contact bridge to provide a continuous circuit when said contact bridge is in tangentical relation with said contacts.

3. The device of claim 2 in which said low pressure switch includes a valve connected to a contact bridge having biasing means disposed therebetween, and contact elements adapted to coact with said contact bridge to complete said circuit.

4. The device of claim 3 in which said timing device comprises a contact bridge adapted to coact with contact elements to complete a circuit, and a solenoid mechanism connected to said contact bridge to make and break the timing device circuit.

5. The device of claim 4 in which said pressure pop off valve comprises a flap valve connected to a rod element provided with biasing means and adjusting means to regulate the activating pressure of said pop off valve.

* * * * *